US010905152B2

(12) United States Patent
Kang et al.

(10) Patent No.: US 10,905,152 B2
(45) Date of Patent: Feb. 2, 2021

(54) BLUNT ROLLING METHOD AND DEVICES

(71) Applicants: Jason Kang, Beverly Hills, CA (US); Daniel Chu, Beverly Hills, CA (US)

(72) Inventors: Jason Kang, Beverly Hills, CA (US); Daniel Chu, Beverly Hills, CA (US)

( * ) Notice: Subject to any disclaimer, the term of this patent is extended or adjusted under 35 U.S.C. 154(b) by 278 days.

(21) Appl. No.: 15/940,614

(22) Filed: Mar. 29, 2018

(65) Prior Publication Data

US 2019/0297936 A1 Oct. 3, 2019

(51) Int. Cl.

| | |
|---|---|
| ***A24C 3/00*** | (2006.01) |
| ***A24C 1/04*** | (2006.01) |
| ***A24C 5/10*** | (2006.01) |
| ***A24F 9/02*** | (2006.01) |
| ***A24C 5/46*** | (2006.01) |
| ***A24C 5/54*** | (2006.01) |
| ***A24F 25/02*** | (2006.01) |
| ***A24C 5/34*** | (2006.01) |

(52) U.S. Cl.

CPC ..... *A24C 3/00* (2013.01); *A24C 1/04* (2013.01); *A24C 5/10* (2013.01); *A24C 5/34* (2013.01); *A24C 5/46* (2013.01); *A24C 5/54* (2013.01); *A24F 9/02* (2013.01); *A24F 25/02* (2013.01)

(58) Field of Classification Search

CPC .... A24C 5/12; A24C 3/00; A24C 5/02; A24C 1/00

See application file for complete search history.

(56) References Cited

U.S. PATENT DOCUMENTS

| | | | | |
|---|---|---|---|---|
| 4,256,124 A * | 3/1981 | Higgins | ..... | A24C 1/32 131/29 |
| 2010/0059075 A1* | 3/2010 | Woodson | ..... | A24C 1/386 131/281 |
| 2013/0192612 A1* | 8/2013 | Prevost | ..... | A24C 5/40 131/77 |

* cited by examiner

*Primary Examiner* — Eric Yaary
*Assistant Examiner* — Jennifer A Kessie
(74) *Attorney, Agent, or Firm* — Edmond DeFrank

(57) ABSTRACT

The embodiments disclose a method including creating a blunt rolling device for rolling blunt smoking products, rolling a wrapper on a wrapper roller tube to create a blunt wrapper tube with a glass tip, tamping smoking material into the blunt wrapper tube at a user defined density, twisting, cutting and tucking wrapper excess into the glass tip, and controlling the operations of the blunt rolling device using a computer, wireless communications and a blunt rolling method and device program for sequencing processes, operating solenoid drive motors and humidity and temperature devices of a smoking material humidor, adjusting settings of devices using predetermined data stored in digital memory devices and accessed using digital processors.

5 Claims, 18 Drawing Sheets

BLUNT ROLLING METHOD AND DEVICES

BACKGROUND

Cigarettes were originally sold with a bag of smoking materials and paper wrappers which the smoker would use to roll their own cigarettes. Subsequently, factory rolled cigarettes come on to the market. Cigars have generally have always been sold pre-rolled by hand. Cigar smokers have not had the opportunity to roll their own cigars to save money.

DETAILED DESCRIPTION OF THE INVENTION

In a following description, reference is made to the accompanying drawings, which form a part hereof, and in which is shown by way of illustration a specific example in which the invention may be practiced. It is to be understood that other embodiments may be utilized and structural changes may be made without departing from the scope of the embodiments.

General Overview

It should be noted that the descriptions that follow, for example, in terms of blunt rolling method and devices, is described for illustrative purposes and the underlying system can apply to any number and multiple types of the smoking materials. In one embodiment of the present invention, the blunt rolling method and devices can be configured using pipe tobacco. In another embodiment, the blunt roller device and method can be used for medical and legalized *cannabis* products and the like. The blunt rolling method and devices can be configured to include the paper blunt wrappers and the smoking material leaf wrappers using the embodiments.

General Overview

Figure 1:
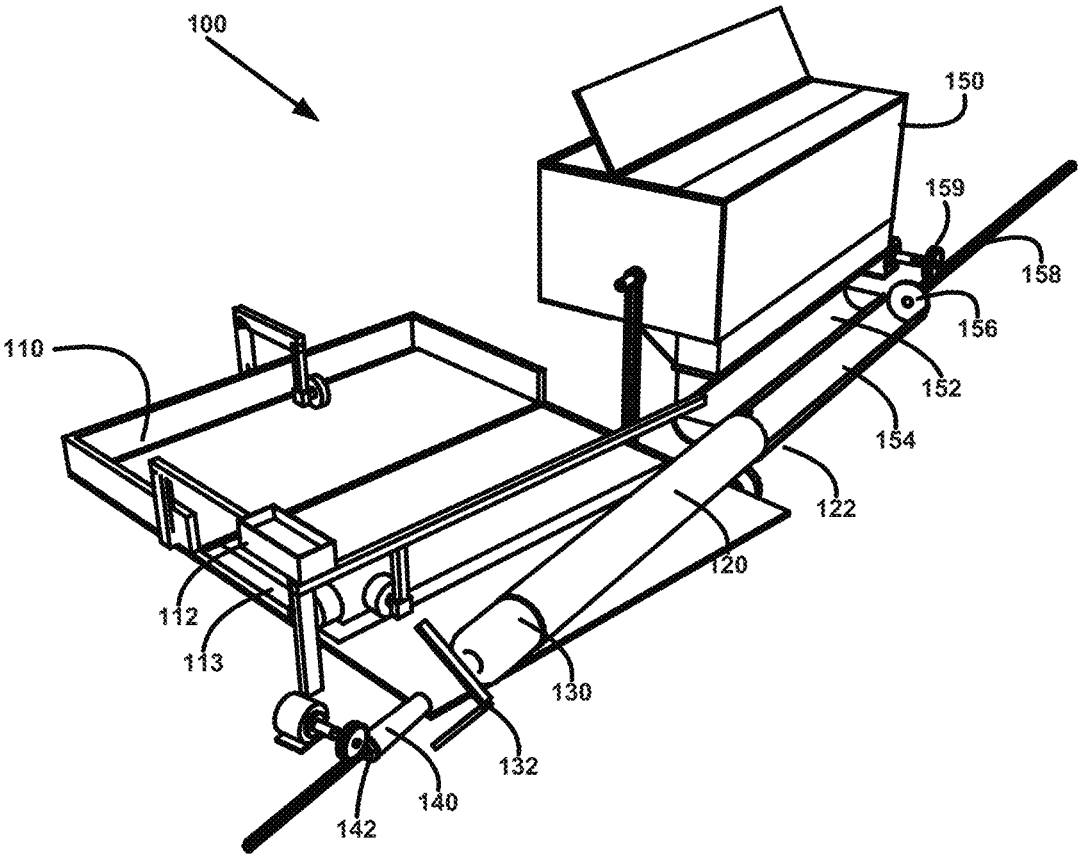
FIG. 1 shows for illustrative purposes only an example of the blunt rolling method and devices of one embodiment.

FIG. 1 shows for illustrative purposes only an example of the blunt rolling method and device of one embodiment. FIG. 1 shows the blunt rolling device 100. The twisted end cutter 640 is configured to include the wrapper supply tray 110. The blunt as herein described is a cigar shaped smoking product. The wrapper can be a precut piece of paper or a precut smoking material leaf. To hold the wrapper in place the wrapper adhesive supply 112 is used and can include a pectin liquid applied to the wrapper for example in the second applied wrapper adhesive strip 113. The wrapper roller tube 120 is used to roll the wrapper into a tube to hold the smoking material pushed inside the wrapper tube. The smoking material is held in a humidor supply dispenser 150 until processed into a smoking material dispensed tray 152 for delivery to a smoking material tamping supply tray 154. The tamping plate 156 coupled to the tamping rod 158 and extended and retracted using the tamper rod activator 159. The glass tip 130 is positioned at one end of the wrapper roller tube 120 wherein the glass tip 130 will be included in the rolled wrapper tube. The wrapper twist device 132 is used to create the twisted end of excess wrapper material at the tip end. The twisted end is tucked into the glass tip 130 and held in place using a crutch 140 inserted into the glass tip 130 using the crutch insertion plate 142 of one embodiment.

The processes described herein are controlled by a computer not shown that includes the blunt rolling method and device program that operates the solenoid motors used to operate a number of devices. Coupling of the computer and the blunt rolling method and device can be a digital wireless connection and can be a hard cabled connection. The user selects a blunt size using the program. The user pushes a start button and begins the operations and processes to roll a blunt. The sequencing of the processes can be automatically repeated wherein the user can select a quantity of blunts to be produced. The blunt rolling method and the device program using the sensors, humidity and temperature control devices in the humidor and not shown monitors the humidor conditions of humidity and temperature and can initiate regulation of the humidity and temperature to predetermined settings selected by the user. Other processes regulated by the blunt rolling method and the device program using digital processors and digital memory storage devices are the raising and lowering of the wrapper roller tube 120 wherein the digital memory storage devices is queried by the digital processors to access the predetermined distance for the vertical distance adjustments corresponding to the size of the blunt selected by the user. Additionally the user can select the tamping density desired. The digital processors access the predetermined tamping density data stored in the digital memory storage devices to adjust the settings on the travel distances of the tamping plate 156 coupled to the tamping rod 158 and operations of the tamper rod activator 159 of one embodiment.

DETAILED DESCRIPTION

Figure 2:
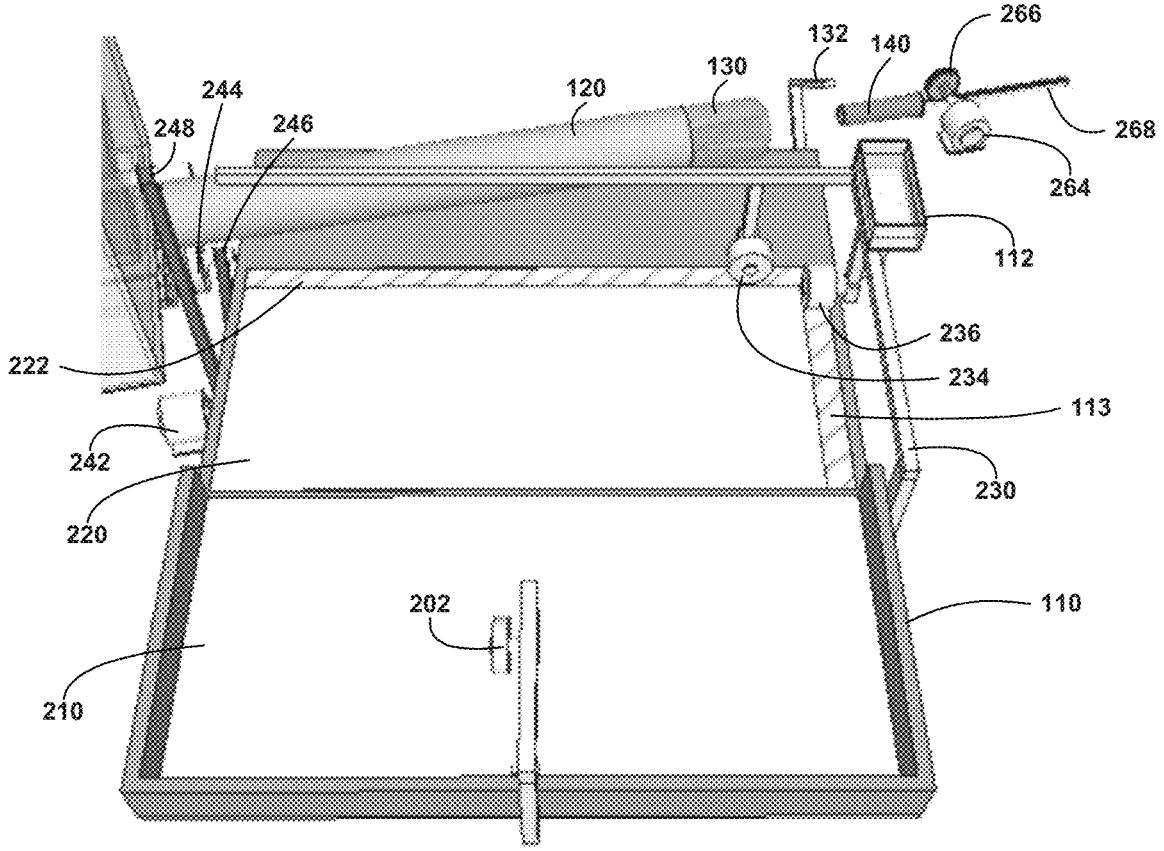
FIG. 2 shows for illustrative purposes only an example of the wrapper preparation device of one embodiment.

FIG. 2 shows for illustrative purposes only an example of the wrapper preparation device of one embodiment. FIG. 2 shows the wrapper supply tray 110 wherein the wrapper dispenser roller 202 positions the wrapper sheet 210 to a staging platform and also showing is the staged wrapper sheet 220. The wrapper adhesive supply 112 supplies the adhesive include a pectin liquid to the first adhesive application roller 234 which rolls the adhesive and applies a first applied adhesive strip 222. The second adhesive application roller 236 applies the adhesive to the second applied wrapper adhesive strip 113. The wrapper roller tube 120 is lowered along with the glass tip 130 to contact an angled section of the first applied adhesive strip 222 of the staged wrapper sheet 220. Also showing, is the wrapper twist device 132 and crutch 140. The wrapper roller tube drive motor 242 coupled to the wrapper roller tube drive wheel 244 with the wrapper roller tube drive belt and pulley 246 for rolling the staged wrapper sheet 220 around the wrapper roller tube 120. The wrapper roller tube drive motor 242 also operates the humidor dispenser drive belt and pulley 248 for dispensing the smoking materials from the humidor for tamping the smoking material into the rolled wrapper. A tuck and crutch drive motor 264 is used to extend and retract a tuck and crutch drive rod 268 using a tuck and crutch drive gear 266 of one embodiment.

Figure 3A:
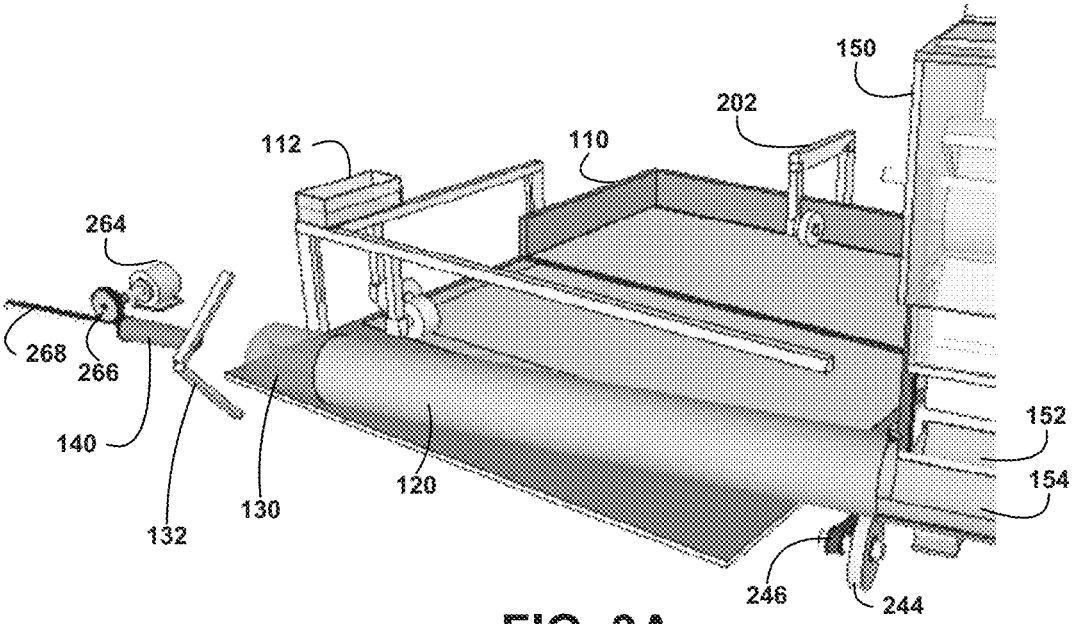
FIG. 3A shows for illustrative purposes only an example of the wrapper rolling device of one embodiment.

Wrapper Rolling Device:

FIG. 3A shows for illustrative purposes only an example of the wrapper rolling device of one embodiment. FIG. 3A shows the wrapper supply tray 110, the wrapper adhesive supply 112, the wrapper roller tube 120, the humidor supply dispenser 150, the smoking material dispensed tray 152, the smoking material tamping supply tray 154, the glass tip 130, the wrapper twist device 132, the crutch 140, the wrapper dispenser roller 202, the tuck and crutch drive motor 264, the tuck and crutch drive rod 268, the tuck and crutch drive gear 266, the wrapper roller tube drive wheel 244, the wrapper roller tube drive belt and pulley 246, the wrapper roller tube drive motor 242, the smoking material tamping supply tray 154 and the smoking material pre-tamp load 317. FIG. 3A shows these wrapper rolling device elements from a different prospective position for clarity of the respective positions of one embodiment.

Figure 3B:
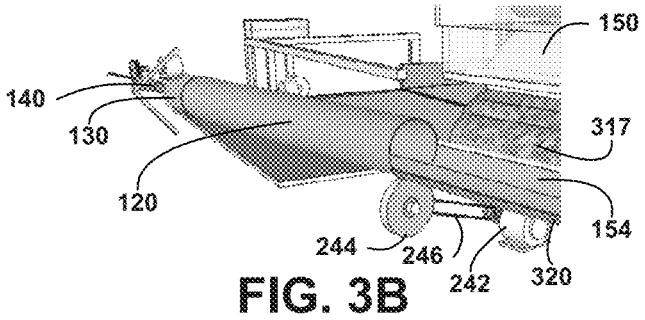
FIG. 3B shows for illustrative purposes only an example of the wrapper roller of one embodiment.

Wrapper Roller:

FIG. 3B shows for illustrative purposes only an example of the wrapper roller of one embodiment. FIG. 3B shows the humidor supply dispenser 150, the wrapper roller tube 120, the smoking material tamping supply tray 154, the glass tip 130, the crutch 140, wrapper twist device 132, the wrapper roller tube drive wheel 244, the wrapper roller tube drive belt and pulley 246, the wrapper roller tube drive motor 242 and the smoking material pre-tamp loader 317. Also showing is the roller and tray slide channel 320. The roller and tray slide channel 320 is a guide for the extending and retracting of the wrapper roller tube 120 and the smoking material tamping supply tray 154. The smoking material pre-tamp loader 317 is rotated to deposit the smoking material into the smoking material tamping supply tray 154 in preparation for tamping into the rolled wrapper of one embodiment.

Figure 4:
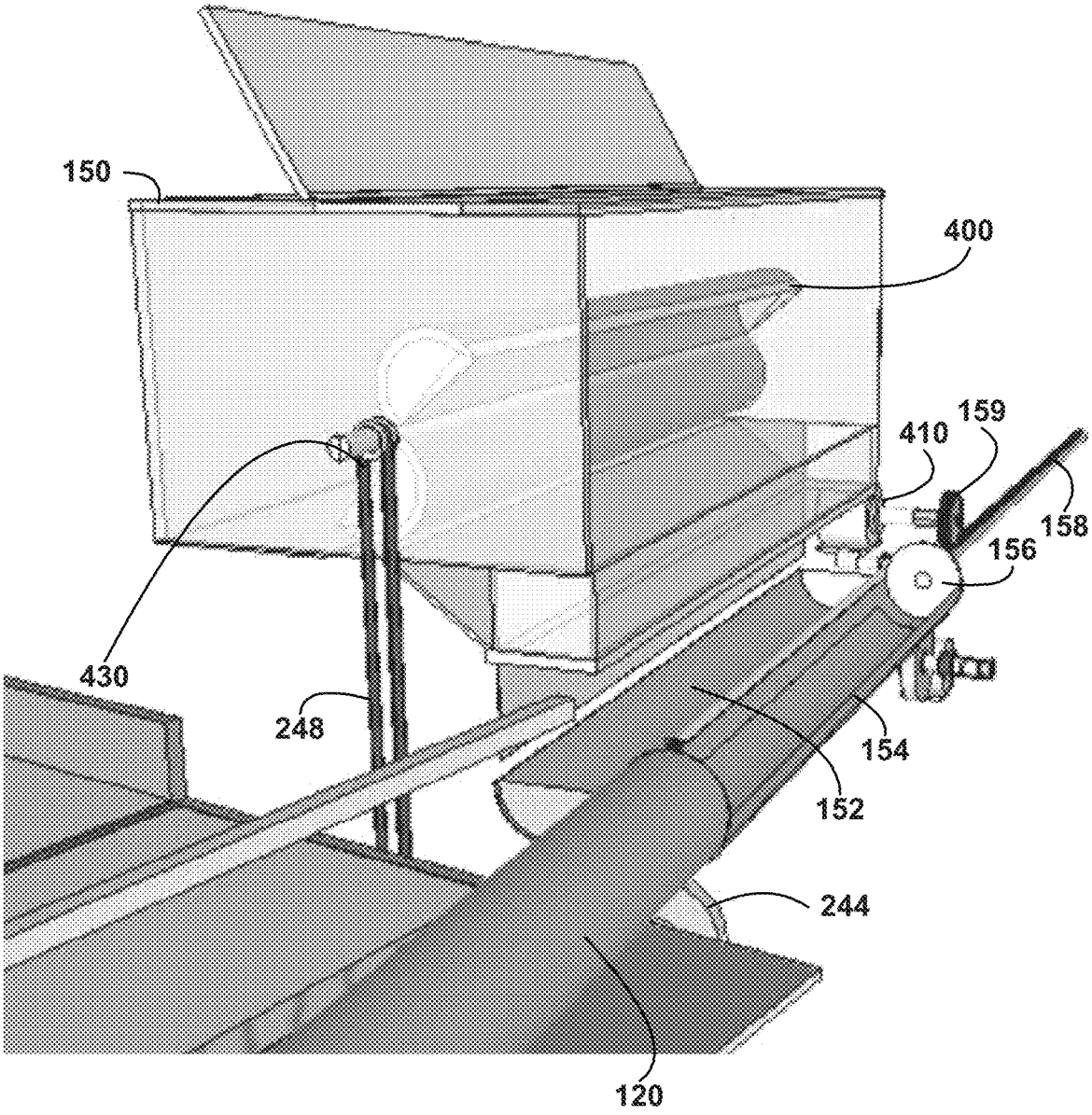
FIG. 4 shows for illustrative purposes only an example of the humidor dispenser of one embodiment.

Humidor Dispenser:

FIG. 4 shows for illustrative purposes only an example of the humidor dispenser of one embodiment. FIG. 4 shows wrapper roller tube 120, smoking material tamping supply tray 154, tamping plate 156, tamping rod 158, and tamper rod activator 159. The humidor supply dispenser 150 includes the humidor dispenser drive belt and pulley 248 used to rotate a smoking material scoop axle 430 to rotate a smoking material scoop 400 to scoop smoking material for dispensing to the smoking material dispensed tray 152. The tamping plate 156, tamping rod 158, and tamper rod activator 159 are operated by a tamping rod drive motor 410. Also showing is the wrapper roller tube drive wheel 244 used to rotate the wrapper roller tube 120 of one embodiment.

Figure 5:
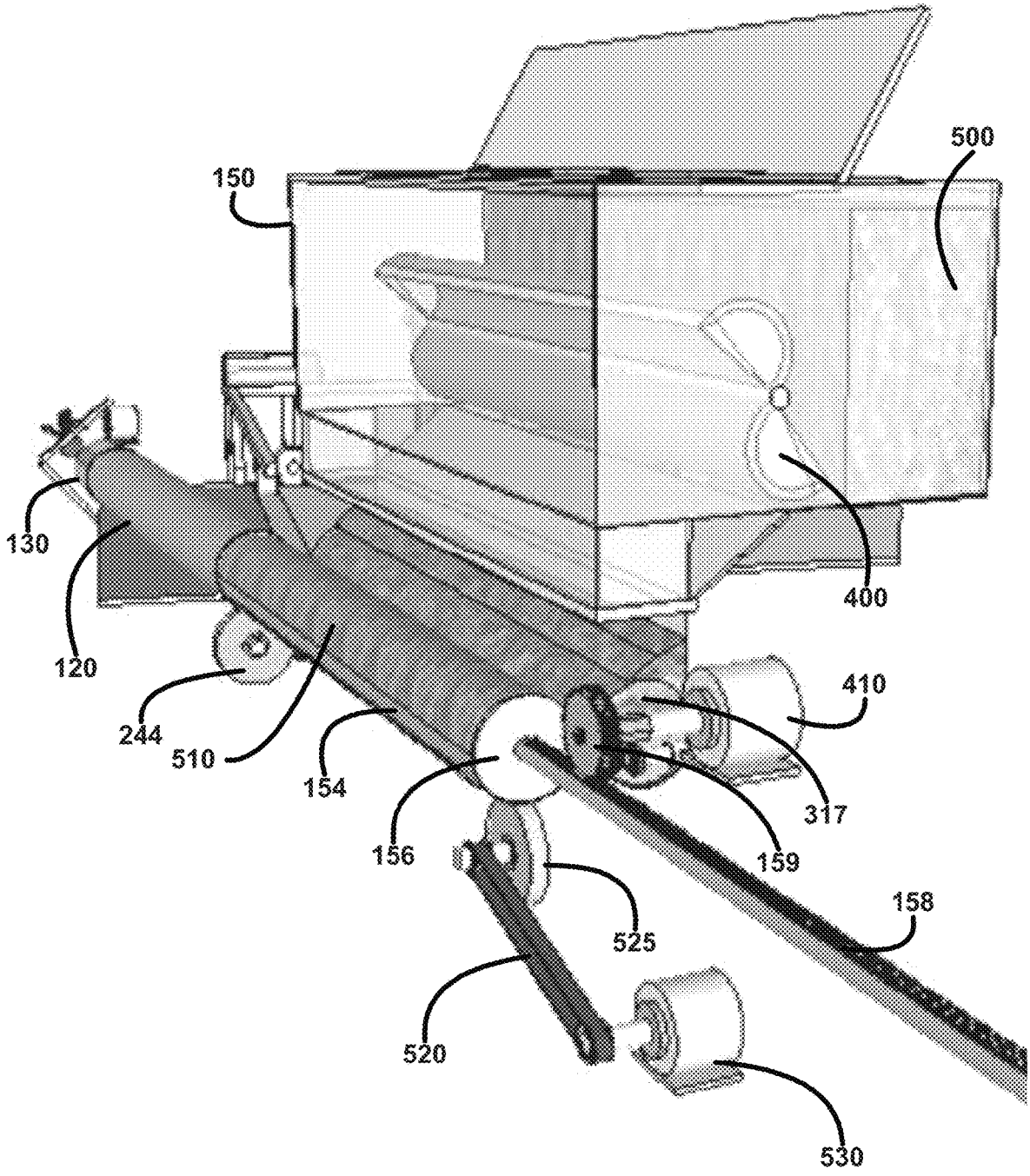
FIG. 5 shows for illustrative purposes only an example of the smoking material tamping device of one embodiment.

Smoking Material Tamping Device:

FIG. 5 shows for illustrative purposes only an example of the smoking material tamping device of one embodiment. FIG. 5 shows the wrapper roller tube 120, the glass tip 130, and the humidor supply dispenser 150 filled with the smoking material supply 500 that is dispensed using the smoking material scoop 400 to form a smoking material pre-tamp load 317. Also showing are the wrapper roller tube drive wheel 244, the smoking material tamping supply tray 154, the tamping plate 156, the tamping rod 158, the tamper rod activator 159 and the tamping rod drive motor 410. The tamping rod 158 is extended towards the rolled wrapper and retracted using the tamping rod drive motor 410. When the full amount of the smoking material has been tamped into the rolled wrapper the wrapper roller tube 120 and smoking material tamping supply tray 154 are retracted using the roller and tray slide drive wheel 525 operated using the roller and the tray slide drive wheel belt and pulley 520 coupled to a roller and tray slide drive wheel motor 530 of one embodiment.

Figure 6A:
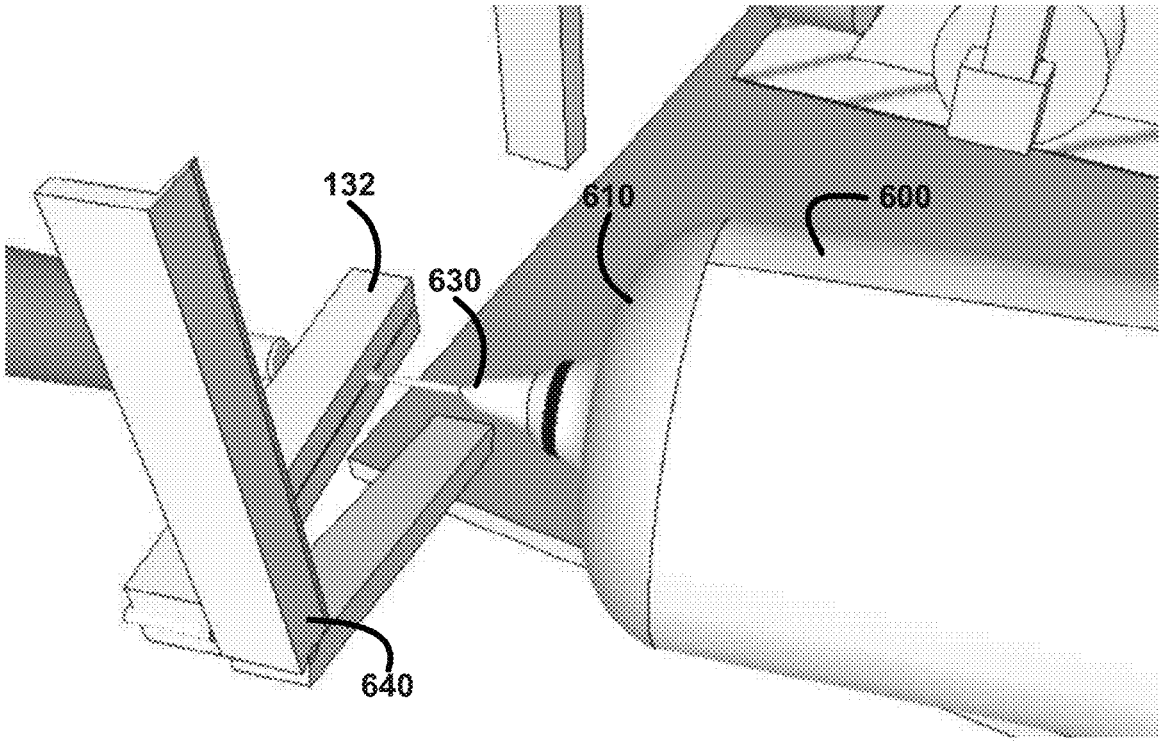
FIG. 6A shows for illustrative purposes only an example of wrapper twist device of one embodiment.

Wrapper Twist Device:

FIG. 6A shows for illustrative purposes only an example of the wrapper twist device of one embodiment. FIG. 6A shows the rolled wrapper 600 and the rolled wrapper tip end 610. The wrapper twist device 132 clamps down on the excess wrapper material at the tip end. The wrapper roller tube 120 of FIG. 1 is rolled to create the rolled wrapper twisted end 630. A twisted end cutter 640 is in the position for cutting a portion of the rolled wrapper twisted end 630 as described in FIG. 6B of one embodiment.

Figure 6B:
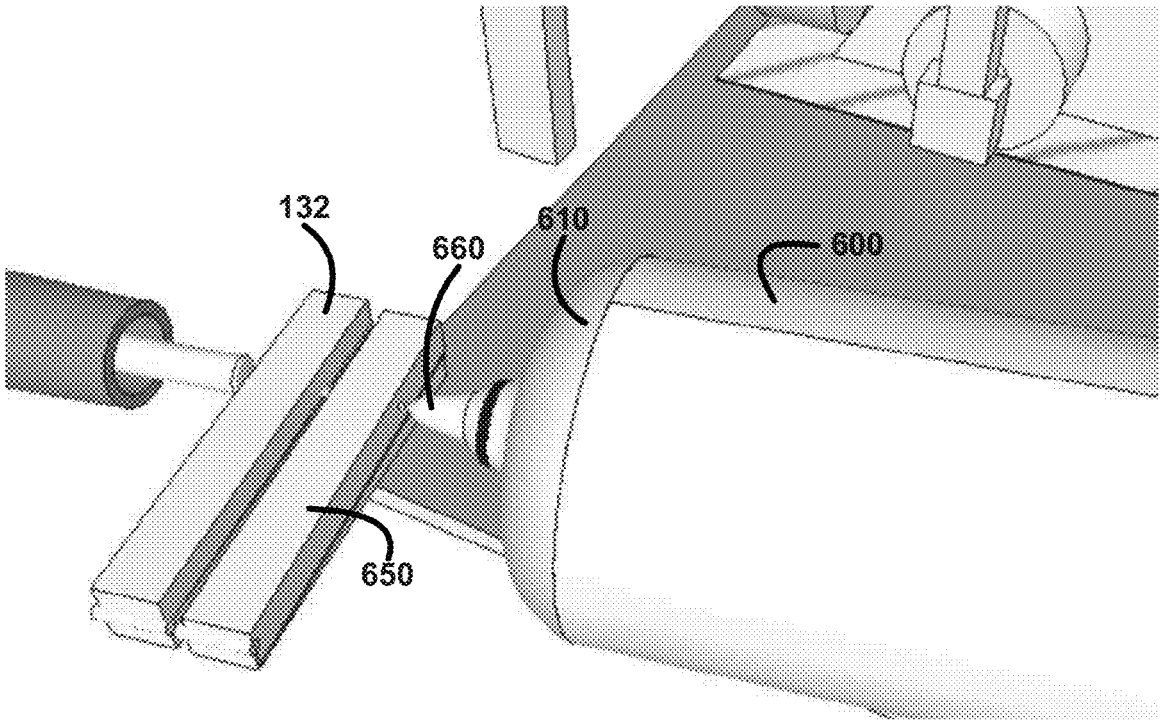
FIG. 6B shows for illustrative purposes only an example of the wrapper trimmer device of one embodiment.

Wrapper Trimmer Device:

FIG. 6B shows for illustrative purposes only an example of the wrapper trimmer device of one embodiment. FIG. 6B shows a continuation of the process from FIG. 6A. Showing is the rolled wrapper 600, rolled wrapper tip end 610 and the wrapper twist device 132. The closed twisted end cutter 650 is shown wherein closing the blades of the twisted end cutter 640 of FIG. 6A are used to cut the wrapper twisted end 660 to a predetermined length of one embodiment.

Figure 7A:
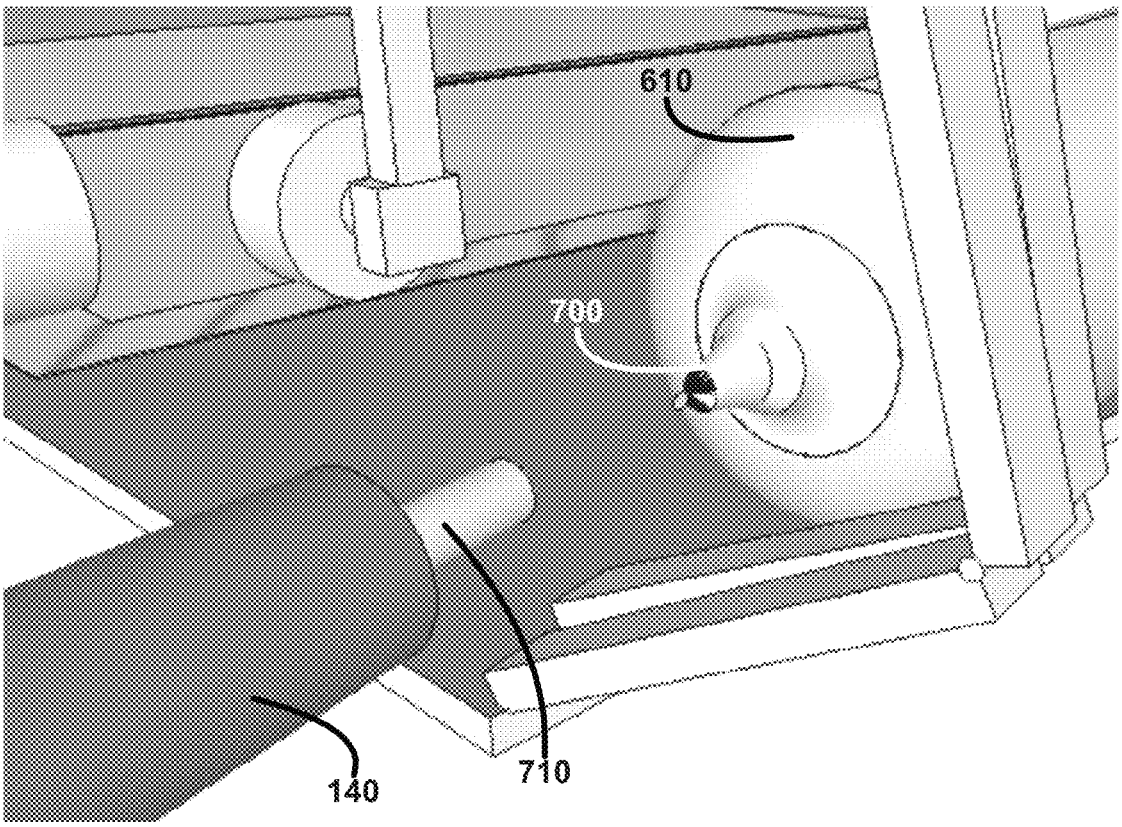
FIG. 7A shows for illustrative purposes only an example of the wrapper tuck device of one embodiment.

Wrapper Tuck Device:

FIG. 7A shows for illustrative purposes only an example of the wrapper tuck device of one embodiment. FIG. 7A shows the rolled wrapper tip end 610 and a twisted wrapper cut stub 700. A tuck rod 710 includes a crutch 140 positioned on the tuck rod 710 for insertion into the tip of one embodiment.

Figure 7B:
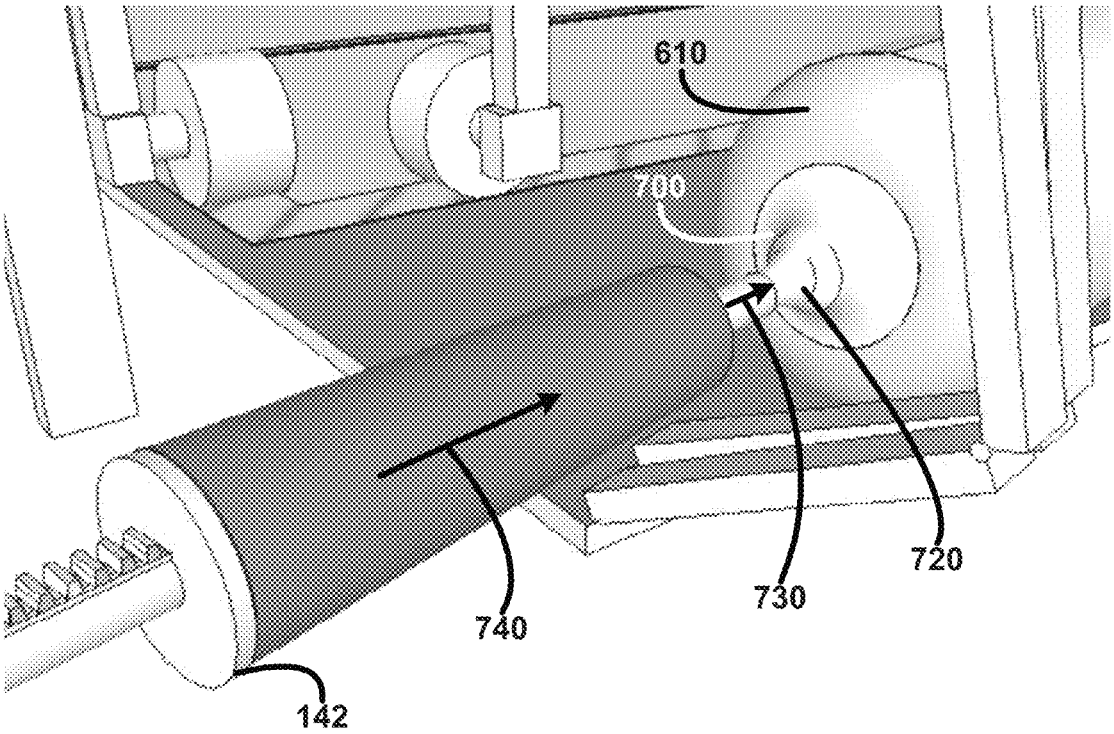
FIG. 7B shows for illustrative purposes only an example of the wrapper tuck process of one embodiment.

Wrapper Tuck Process:

FIG. 7B shows for illustrative purposes only an example of the wrapper tuck process of one embodiment. FIG. 7B shows a continuation of the process from FIG. 7A. The rolled wrapper tip end 610 includes the twisted wrapper cut stub 700. The crutch insertion plate 142 is extended towards the tip wherein the tuck rod is pushed into the tip and tucks the cut wrapper excess into the tip 730. The crutch insertion plate 142 pushes the crutch into the tip to hold the tucked wrapper excess inside the tip 740. After the insertion of crutch the cut wrapper excess 720 is secured flush against the tip of one embodiment.

Figure 8:
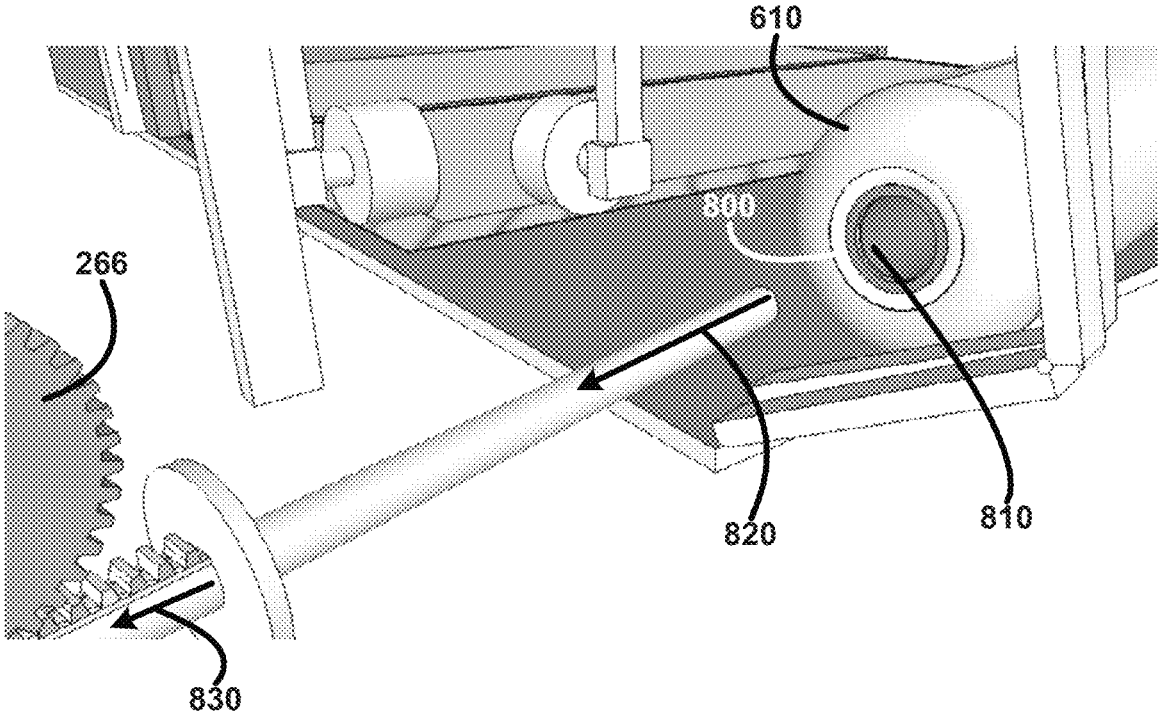
FIG. 8 shows for illustrative purposes only an example of the crutch insertion process of one embodiment.

Crutch Insertion Process:

FIG. 8 shows for illustrative purposes only an example of the crutch insertion process of one embodiment. FIG. 8 shows the rolled wrapper tip end 610 and the tucked cut wrapper excess 800 in the tip. An inserted crutch 810 has been pushed into the tip to secure the tucked cut wrapper excess 800 in the tip. The tuck and crutch drive gear 266 is rotated in reverse for retracting the tuck and crutch drive rod 830 and for retracting the tuck rod 820 of one embodiment.

Figure 9:
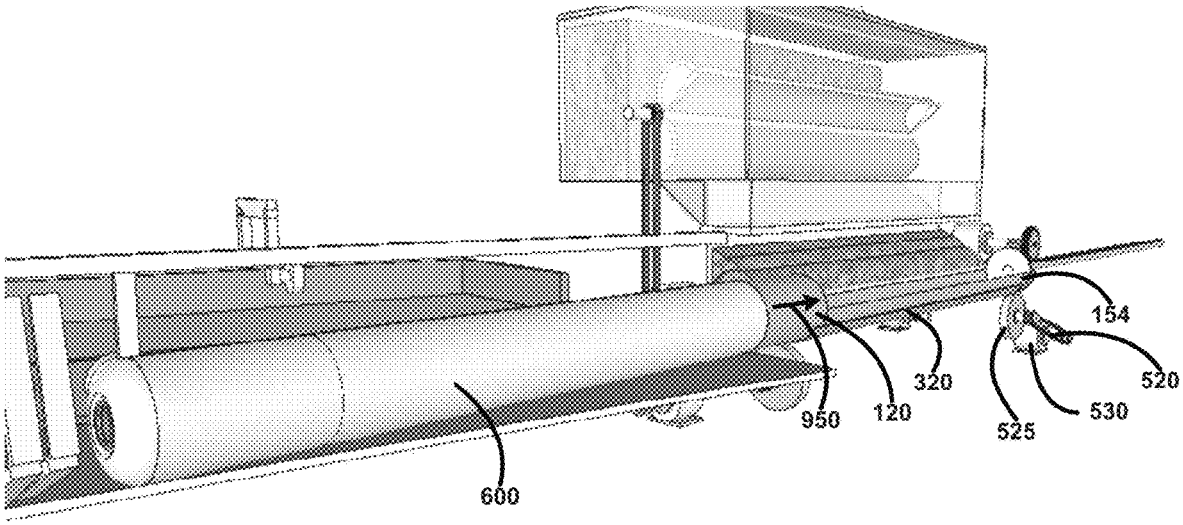
FIG. 9 shows for illustrative purposes only an example of the first wrapper roller withdrawal process of one embodiment.

First Wrapper Roller Withdrawal Process:

FIG. 9 shows for illustrative purposes only an example of the first wrapper roller withdrawal process of one embodiment. FIG. 9 shows the rolled wrapper 600, the wrapper roller tube 120, the smoking material tamping supply tray 154, the roller and tray slide drive wheel 525, the roller and tray slide drive wheel belt and pulley 520, the roller and tray slide drive wheel motor 530 and the roller and tray slide channel 320. A process begins wherein the wrapper roller tube pulled out of rolled wrapper 950 to prepare for a final tamping of the smoking material of one embodiment.

Figure 10:
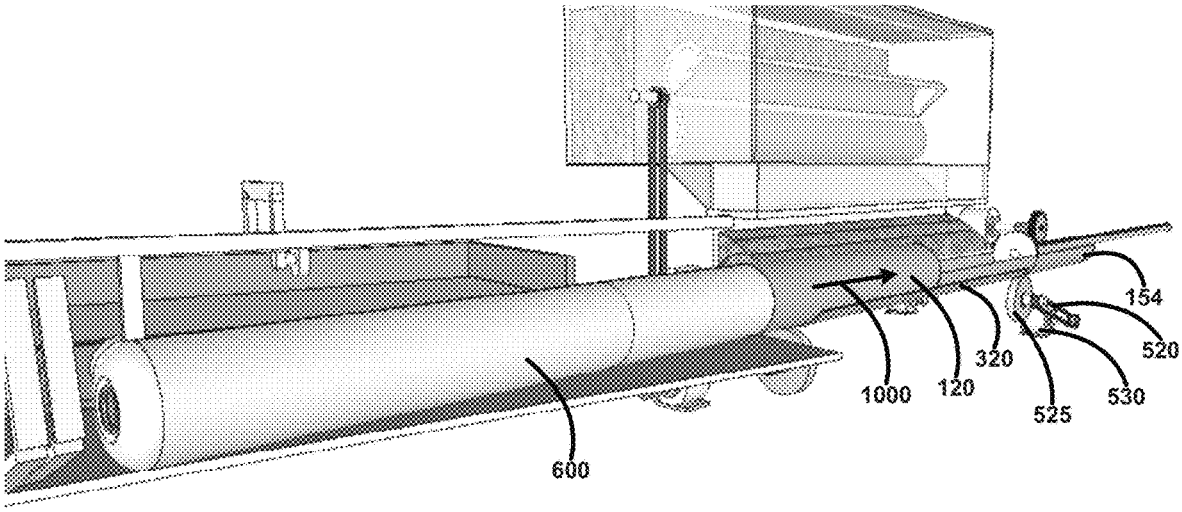
FIG. 10 shows for illustrative purposes only an example of the second wrapper roller withdrawal process of one embodiment.

Second Wrapper Roller Withdrawal Process:

FIG. 10 shows for illustrative purposes only an example of the second wrapper roller withdrawal process of one embodiment. FIG. 10 shows the rolled wrapper 600, the wrapper roller tube 120, the smoking material tamping supply tray 154, the roller and tray slide drive wheel 525, the roller and tray slide drive wheel belt and pulley 520, the roller and tray slide drive wheel motor 530 and roller and the tray slide channel 320. The wrapper roller tube pulled out of the rolled wrapper sliding on the roller and tray slide channel 1000 of one embodiment.

Figure 11:
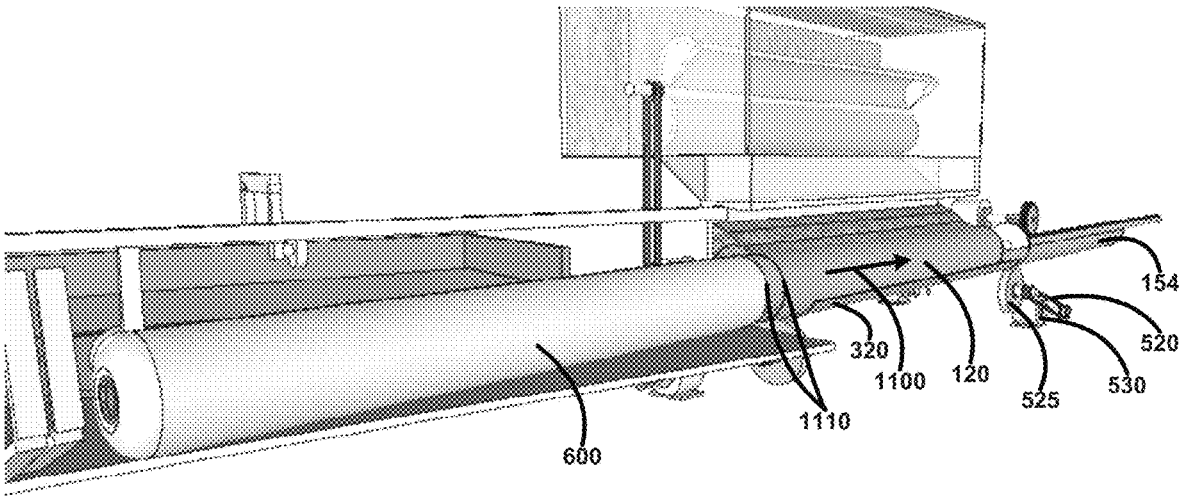
FIG. 11 shows for illustrative purposes only an example of the final roller withdrawal process of one embodiment.

Final Roller Withdrawal Process:

FIG. 11 shows for illustrative purposes only an example of the final roller withdrawal process of one embodiment. FIG. 11 shows the rolled wrapper 600, the wrapper roller tube 120, the smoking material tamping supply tray 154, the roller and tray slide drive wheel 525, the roller and tray slide drive wheel belt and pulley 520, the roller and tray slide drive wheel motor 530 and the roller and tray slide channel 320. The wrapper roller tube pulled completely out of the rolled wrapper 1100 is shown positioned to a predetermined gap opening of the wrapper roller tube and blunt 1110 of one embodiment.

Figure 12:
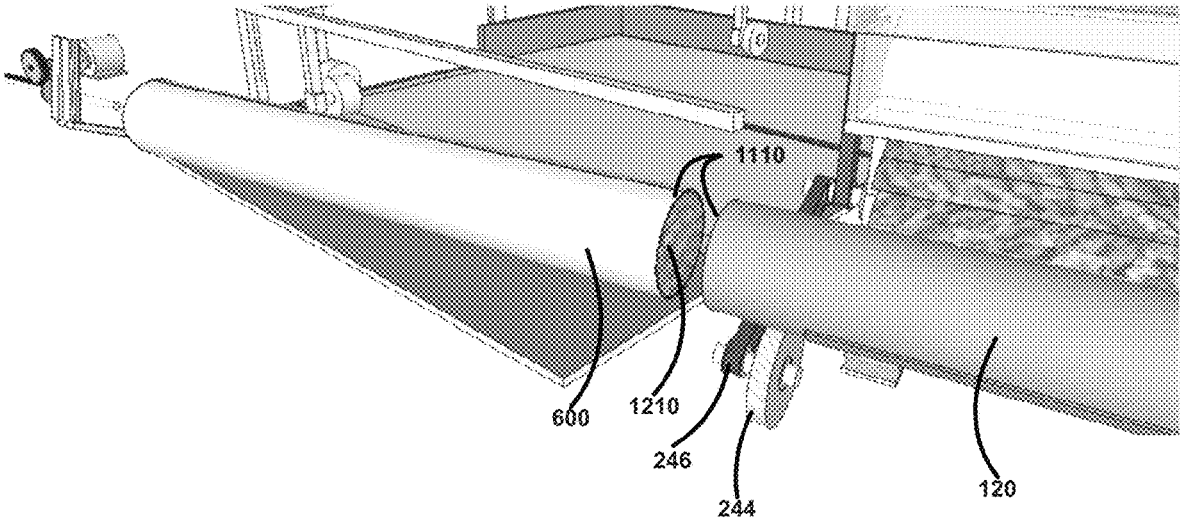
FIG. 12 shows for illustrative purposes only an example of the smoking material tamped of one embodiment.

Smoking Material Tamped:

FIG. 12 shows for illustrative purposes only an example of the smoking material tamped of one embodiment. FIG. 12 shows the rolled wrapper 600, the wrapper roller tube 120, the wrapper roller tube drive wheel 244, he wrapper roller tube drive belt and pulley 246 and predetermined gap opening of the wrapper roller tube and blunt 1110. A packed tamped smoking material 1210 is shown at the end of the blunt opposite the tip end of one embodiment.

Figure 13:
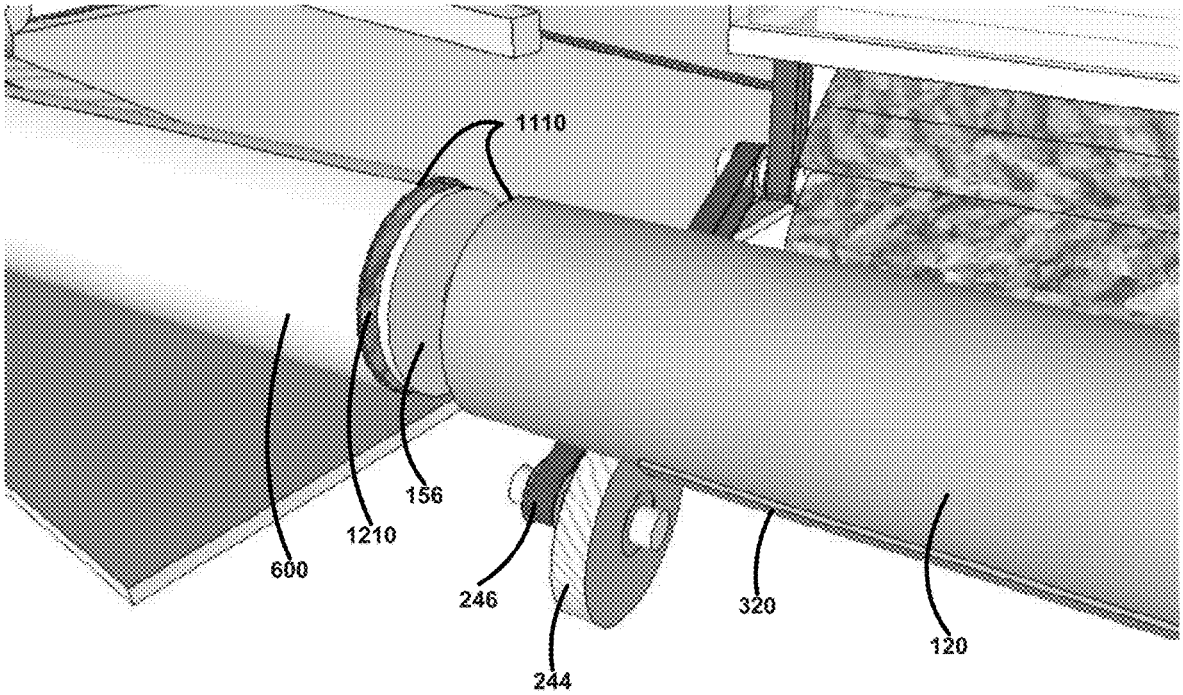
FIG. 13 shows for illustrative purposes only an example of final smoking material tamping process of one embodiment.

Final Smoking Material Tamping Process:

FIG. 13 shows for illustrative purposes only an example of the final smoking material tamping process of one embodiment. FIG. 13 shows the rolled wrapper 600, wrapper roller tube 120, the wrapper roller tube drive wheel 244, the wrapper roller tube drive belt and pulley 246, the predetermined gap opening of the wrapper roller tube and blunt 1110, the packed tamped smoking material 1210 and the tamping plate 156. The tamping plate 156 is positioned against the packed tamped smoking material 1210 to perform the final tamping process to press the smoking materials firmly against the rolled wrapper of one embodiment.

Figure 14A:
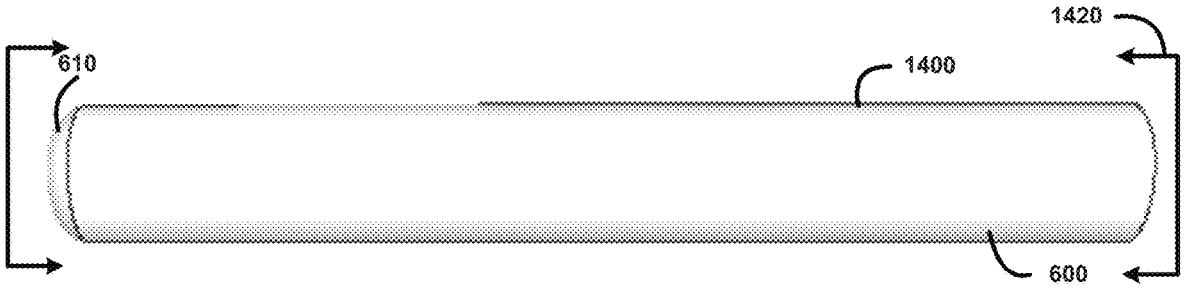
FIG. 14A shows for illustrative purposes only an example of the blunt section lines of one embodiment.

Blunt Section Lines:

FIG. 14A shows for illustrative purposes only an example of the blunt section lines of one embodiment. FIG. 14A shows the rolled wrapper 600, the rolled wrapper tip end 610, the complete blunt 1400 and section cut lines 1420 of one embodiment.

Figure 14B:
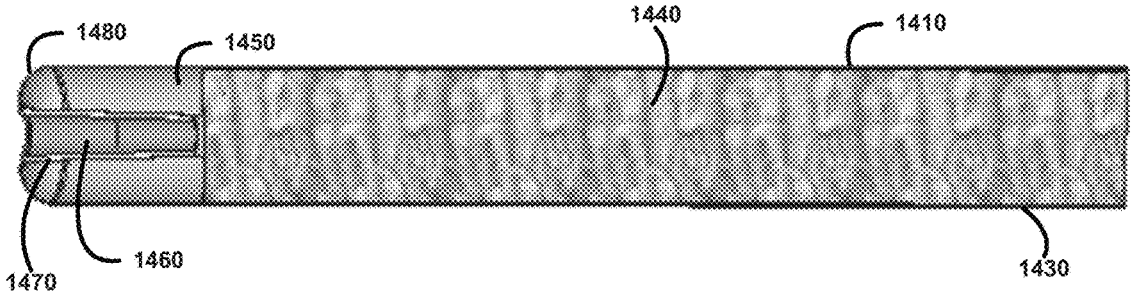
FIG. 14B shows for illustrative purposes only an example of the blunt cross section of one embodiment.

Blunt Cross Section:

FIG. 14B shows for illustrative purposes only an example of the blunt cross section of one embodiment. FIG. 14B shows the complete blunt section view 1410 showing the rolled wrapper layer 1430, the final packed tamped smoking material 1440, the rolled wrapper tip end layer 1480, the tip cross section 1450, the crutch cross section 1460 and the tucked cut wrapper excess layer 1470 of one embodiment.

Figure 15:
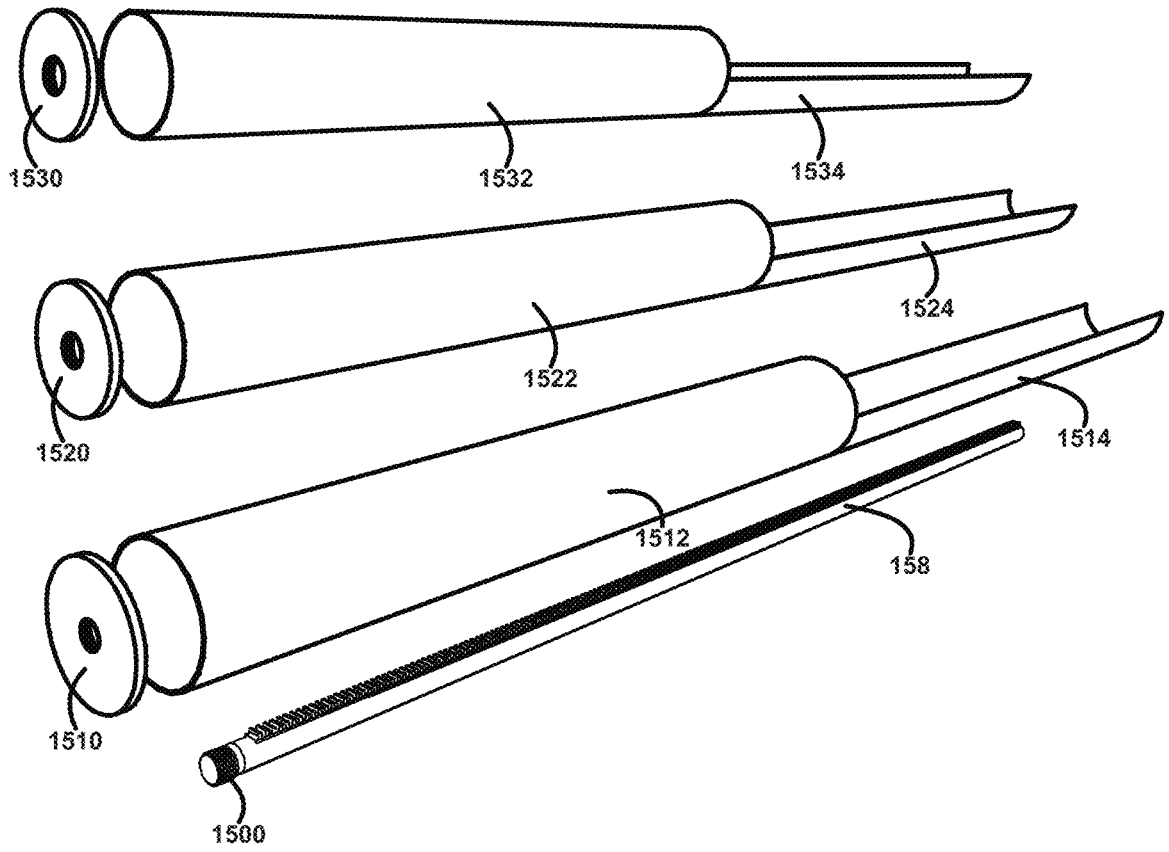
FIG. 15 shows for illustrative purposes only an example of the blunt roller and tamper sizes of one embodiment.

Blunt Roller and Tamper Sizes:

FIG. 15 shows for illustrative purposes only an example of blunt roller and tamper sizes of one embodiment. FIG. 15 shows the tamping rod 158 with a threaded rod end 1500. The threaded rod end 1500 screws into the threaded hole in the center of a tamping plate. Also showing is a matched set of the 13 mm tamping plate 1510, the 13 mm wrapper roller tube 1512 and the 13 mm smoking material tamping supply tray 1514. A matching set of 12 mm tamping plate 1520, 12 mm wrapper roller tube 1522 and a 12 mm smoking material tamping supply tray 1524 is shown. FIG. 15 shows a matched set of a 10 mm tamping plate 1530, 10 mm wrapper roller tube 1532 and a 10 mm smoking material tamping supply tray 1534. The mm dimension is the outer diameter of the tamping plate, inside diameter of the wrapper roller tube and smoking material tamping supply tray of one embodiment.

Figure 16A:
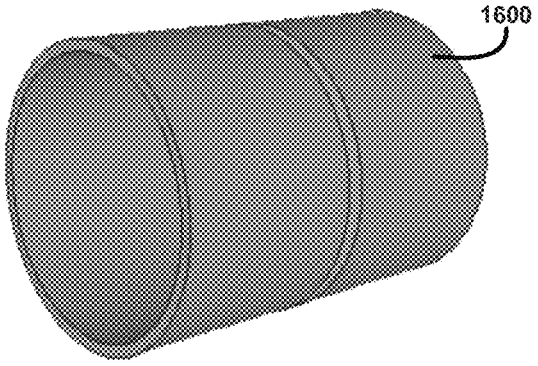
FIG. 16A shows for illustrative purposes only an example of the blunt tip cutter device of one embodiment.

Blunt Tip Cutter Device:

FIG. 16A shows for illustrative purposes only an example of the blunt tip cutter device of one embodiment. FIG. 16A shows a cap cutter 1600 of one embodiment.

Figure 16B:
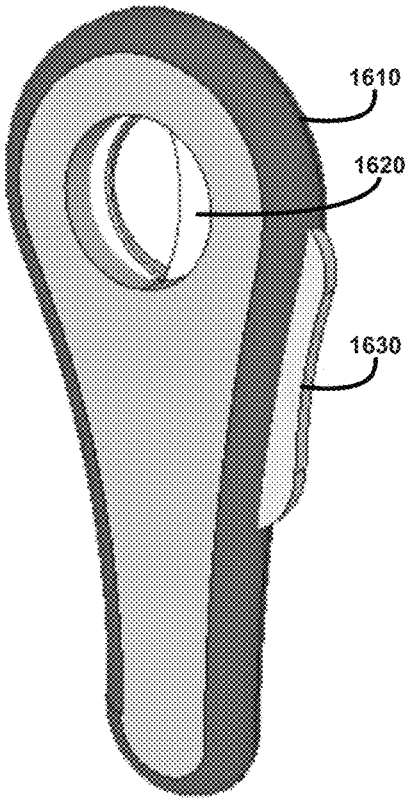
FIG. 16B shows for illustrative purposes only an example of the wrapper cutter device of one embodiment.

Wrapper Cutter Device:

FIG. 16B shows for illustrative purposes only an example of the wrapper cutter device of one embodiment. FIG. 16B shows the tobacco leaf cutter 1610 used for cutting tobacco leaves into wrapper dimensions. The tobacco leaf cutter 1610 is configured to include the cutter blade lever 1630 and at least one cutter blade 1620 of one embodiment.

Figure 17A:
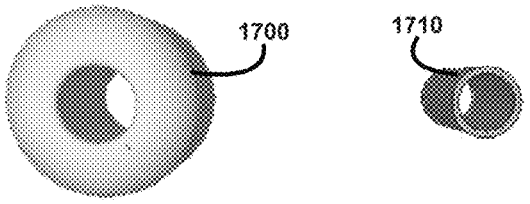
FIG. 17A shows for illustrative purposes only an example of the 13 mm non-tapered tip and non-tapered crutch device end view of one embodiment.

13 mm Tip and Non-Tapered Crutch Device End View:

FIG. 17A shows for illustrative purposes only an example of the 13 mm non-tapered tip and non-tapered crutch device end view of one embodiment. FIG. 17A shows the 13 mm non-tapered tip end view 1700 and the 13 mm non-tapered crutch end view 1710, wherein the outside diameter of the tip is 13 mm. The crutch dimensions of each crutch shown in FIG. 17A to FIG. 18D match the inside dimensions of the center hole of its corresponding tip of one embodiment.

Figure 17C:
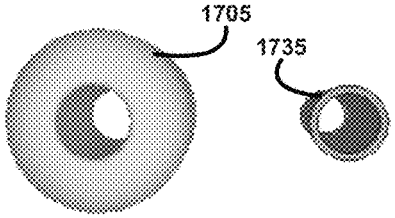
FIG. 17C shows for illustrative purposes only an example of the 13 mm tapered tip and tapered crutch device end view of one embodiment.
Figure 17B:
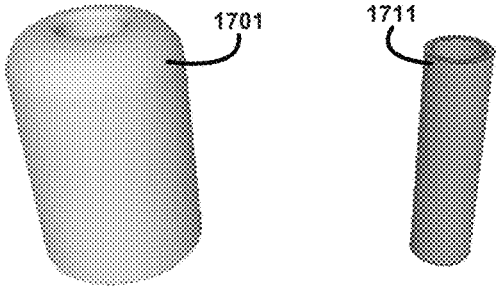
FIG. 17B shows for illustrative purposes only an example of the 13 mm non-tapered tip and non-tapered crutch device side view of one embodiment.

13 mm Tip and Non-Tapered Crutch Device Side View:

FIG. 17B shows for illustrative purposes only an example of 13 mm non-tapered tip and non-tapered crutch device side view of one embodiment. FIG. 17B shows a 13 mm non-tapered tip side view 1701 and a 13 mm non-tapered crutch side view 1711 of one embodiment.

13 mm Tip and Tapered Crutch Device End View:

FIG. 17C shows for illustrative purposes only an example of 13 mm tapered tip and tapered crutch device end view of one embodiment. FIG. 17C shows a 13 mm tapered tip end view 1705 and a 13 mm tapered crutch device end view 1735, wherein the outside diameter of the tip is 13 mm of one embodiment.

Figure 17D:
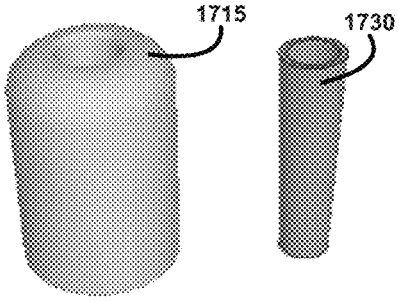
FIG. 17D shows for illustrative purposes only an example of the 13 mm tapered tip and tapered crutch device side view of one embodiment.

13 mm Tip and Tapered Crutch Device Side View:

FIG. 17D shows for illustrative purposes only an example of 13 mm tapered tip and tapered crutch device side view of one embodiment. FIG. 17D shows a 13 mm tapered tip side view 1715 and a 13 mm tapered crutch device side view 1730 of one embodiment.

Figure 18A:
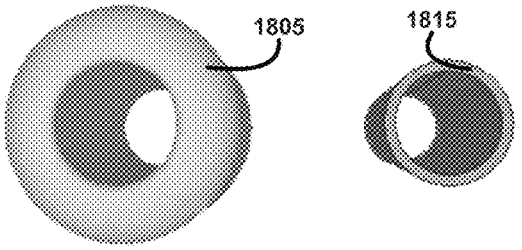
FIG. 18A shows for illustrative purposes only an example of the 12 mm tapered tip and tapered crutch device end view of one embodiment.

12 mm Tip and Tapered Crutch Device End View:

FIG. 18A shows for illustrative purposes only an example of 12 mm tapered tip and tapered crutch device end view of one embodiment. FIG. 18A shows a 12 mm tapered tip end view 1805 and a 12 mm tapered crutch device end view 1815, wherein the outside diameter of the tip is 12 mm of one embodiment.

Figure 18C:
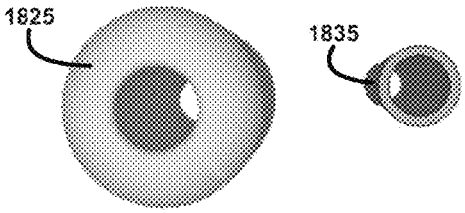
FIG. 18C shows for illustrative purposes only an example of the 10 mm tapered tip and tapered crutch device end view of one embodiment.
Figure 18B:
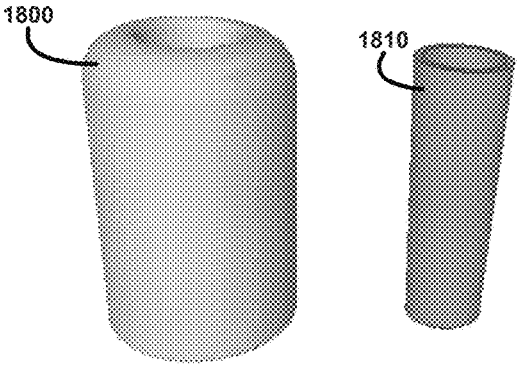
FIG. 18B shows for illustrative purposes only an example of the 12 mm tapered tip and tapered crutch device side view of one embodiment.

12 mm TIP AND Tapered CRUTCH DEVICE SIDE VIEW:

FIG. 18B shows for illustrative purposes only an example of 12 mm tapered tip and tapered crutch device side view of one embodiment. FIG. 18B shows a 12 mm tapered tip side view 1800 and a 12 mm tapered crutch device side view 1810 of one embodiment.

10 mm Tip and Tapered Crutch Device End View:

FIG. 18C shows for illustrative purposes only an example of 10 mm tapered tip and tapered crutch device end view of one embodiment. FIG. 18C shows a 10 mm tapered tip end view 1825 and a 10 mm tapered crutch device end view 1835, wherein the outside diameter of the tip is 10 mm of one embodiment.

Figure 18D:
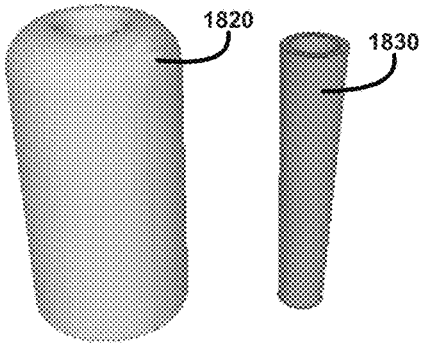
FIG. 18D shows for illustrative purposes only an example of the 10 mm tapered tip and tapered crutch device side view of one embodiment.

10 mm Tip and Tapered Crutch Device Side View:

FIG. 18D shows for illustrative purposes only an example of 10 mm tapered tip and tapered crutch device side view of one embodiment. FIG. 18D shows a 10 mm tapered tip side view 1820 and a 10 mm tapered crutch device side view 1830 of one embodiment.

The foregoing has described the principles, embodiments and modes of operation of the embodiments. However, the embodiments should not be construed as being limited to the particular embodiments discussed. The above described embodiments should be regarded as illustrative rather than restrictive, and it should be appreciated that variations may be made in those embodiments by workers skilled in the art without departing from the scope of the present invention as defined by the following claims.

What is claimed is:

1. An apparatus, comprising:

a blunt rolling device for rolling blunt smoking products; at least one wrapper roller tube to create a blunt wrapper tube;

at least one glass tip to couple with the blunt wrapper tube; a humidor for storing smoking material for dispensing smoking material for tamping into the blunt wrapper tube;

at least one tamping device for tamping a quantity of smoking material into the blunt wrapper tube at a user defined density;

a wrapper twist device and a twisted end cutter for twisting, cutting wrapper excess;

at least one crutch device for tucking cut wrapper excess into the at least one glass tip; and a digital control system for controlling the processes and operations of the blunt rolling device.

2. The apparatus of claim 1, wherein the at least one wrapper roller tube includes a 13 mm, 12 mm and 10 mm inside diameter wrapper roller tube.

3. The apparatus of claim 1, wherein then at least one glass tip includes a 13 mm non-tapered tip, a 13 mm tapered tip, a 12 mm tapered tip, and a 10 mm tapered tip.

4. The apparatus of claim 1, wherein a digital control system includes a blunt rolling method and device program, wireless communications, digital processors, and digital memory storage devices.

5. The apparatus of claim 1, wherein a humidor includes humidity and temperature devices for adjusting humidity and temperature within the humidor.

* * * * *